US007217047B2

(12) United States Patent
Maruyama

(10) Patent No.: US 7,217,047 B2
(45) Date of Patent: May 15, 2007

(54) THERMAL TRANSFER PRINTER

(75) Inventor: Takahito Maruyama, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/142,724

(22) Filed: Jun. 1, 2005

(65) Prior Publication Data

US 2005/0271440 A1 Dec. 8, 2005

(30) Foreign Application Priority Data

Jun. 3, 2004 (JP) ..... 2004-165534

(51) Int. Cl.
*B41J 35/28* (2006.01)

(52) U.S. Cl. ..... 400/207; 400/208; 347/214

(58) Field of Classification Search ..... None
See application file for complete search history.

(56) References Cited

U.S. PATENT DOCUMENTS

| | | | | |
|---|---|---|---|---|
| 4,621,270 | A * | 11/1986 | Mizutani et al. | 347/176 |
| 4,733,980 | A * | 3/1988 | Tosa | 400/207 |
| 4,910,602 | A * | 3/1990 | Sakuragi | 358/296 |
| 4,914,452 | A * | 4/1990 | Fukawa | 347/214 |
| 4,978,240 | A * | 12/1990 | Katsuno | 400/224.2 |
| 5,220,352 | A | 6/1993 | Yamamoto et al. | |
| 5,584,587 | A | 12/1996 | Koike et al. | |
| 5,921,687 | A | 7/1999 | Koike et al. | |
| 6,504,564 | B1 | 1/2003 | Funaki et al. | |

FOREIGN PATENT DOCUMENTS

| | | |
|---|---|---|
| EP | 0294792 | 12/1988 |
| JP | 2002-120446 | 4/2002 |
| JP | 2002-144616 | 5/2002 |
| JP | 2002144616 | 5/2002 |

OTHER PUBLICATIONS

Search Report dated Nov. 9, 2006 for corresponding European Patent Application No. 05 011 954.

* cited by examiner

*Primary Examiner*—Daniel J. Colilla
*Assistant Examiner*—Jill E. Culler
(74) *Attorney, Agent, or Firm*—Brinks Hofer Gilson & Lione

(57) ABSTRACT

In a ribbon cassette which is used in a thermal transfer printer of the present invention, a head insertion section, in which a thermal head is inserted to turn its head up and down, is formed between a first ribbon housing section and a second ribbon housing section and further, a relief groove having a predetermined depth, in which a paper feeding mechanism can be positioned, is formed between the head insertion section and the second ribbon housing section. In the relief groove, an ink ribbon to be taken up around a take-up reel is exposed and, in a cassette mounting section, a ribbon guide section is formed to help the ink ribbon to be taken up around the take-up reel in the state where the ink ribbon exposed to the relief groove of the mounted ribbon cassette is bent toward the lower portion of the relief groove.

3 Claims, 2 Drawing Sheets

THERMAL TRANSFER PRINTER

BACKGROUND OF THE INVENTION

1. Field of the Invention

This application claims the benefit of priority to Japanese Patent Application No. 2004-165534, filed on Jun. 3, 2004, herein incorporated by reference.

The present invention relates to a thermal transfer printer, more specifically, to a thermal transfer printer capable of reducing cost by reducing the number of the components of the ribbon cassette.

2. Description of the Related Art

A conventional thermal transfer printer 31 will be described with reference to a drawing.

As shown in FIG. 3, the thermal transfer printer 31 includes a printer main body 31*a*, and a cassette mounting section 31*b* capable of mounting a ribbon cassette 39 to be described later in the printer main body 31*a*.

A rotatable platen roller 32 is arranged in the printer main body 31*a*, and a thermal head 33 is arranged on the platen roller 32.

A recording paper 34 is fed between the thermal head 33 and the platen roller 32 so as to be carried in the direction of an arrow A.

The thermal head 33 is supported by a head mounting table 35 which is mounted on a head lever 36. The head lever 36 is turned about a supporting shaft 37 as a fulcrum, so that the thermal head 33 can be brought into contact with and separated from the platen roller 32 (head up/down).

When a ribbon cassette 39 to be described later is mounted on the cassette mounting section 31*b* in a state in which the thermal head 33 is separated from the platen roller 32 (head up), an ink ribbon 38 is positioned between the platen roller 32 and the thermal head 33.

The ink ribbon 38 is formed to have a slightly wider width than the recording paper 34 and both ends of the ink ribbon 38 are wound around a supply reel 39*a* and a take-up reel 39*b*, respectively. The supply reel 39*a* and the take-up reel 39*b* are rotatably supported in ribbon housing sections 39*c* facing each other so as to be housed in the ribbon cassette 39.

When the ribbon cassette 39 is mounted on the cassette mounting section 31*b*, the take-up reel 39*b* is engaged with a take-up bobbin (not shown) of the printer main body section 31*a* so as to be rotated by the rotation of the take-up bobbin.

When the take-up reel 39*b* is rotated in the counterclockwise direction by rotating the take-up bobbin in the counterclockwise direction, the ink ribbon 38 wound around the supply reel 39*a* can be wound around the take-up reel 39*b*.

Further, the ribbon cassette 39 is provided with a relief groove 39*d* for relieving a pressing roller 41 to be described later, and a take-up port 39*e* is provided in the lower portion of the relief groove 39*d*. In addition, a guide roller 39*f* made of metallic rod is rotatably supported on a side plate adjacent to the take-up port 39*e*.

The ink ribbon 38 to be wound around the take-up reel 39*b* is detached at a predetermined detachment angle from a ribbon detaching member 42 provided downstream in the ribbon-feeding direction of the thermal head 33. Then, the ink ribbon 38 is bent substantially orthogonally by the guide roller 39*f* so as to be wound around the take-up reel 39*b*.

In addition, a paper feeding roller 40 and a pressing roller 41 which is pressed against the paper feeding roller 40 are arranged on the left side of the platen roller 32 in FIG. 3. The recording paper 34 is interposed between the paper feeding roller 40 and the pressing roller 41 so that the recording paper 34 can be carried in the direction of the arrow A by the rotation of the paper feeding roller 40 in the counterclockwise direction.

When the ribbon cassette 39 is mounted on the cassette mounting section 31*b*, the pressing roller 41 is positioned in the relief groove 39*d*.

The above-mentioned conventional thermal transfer printer is described in Japanese Unexamined Patent Application Publication Nos. 2002-144616 and 2002-120446.

However, since the above-mentioned conventional thermal transfer printer 31 uses the high-cost guide roller 31 made of metal in the ribbon cassette 39, cost is increased.

In addition, when the ink ribbon 38 of ink is used up, the ribbon cassette 39 is discarded. In this case, since the guide roller 39*f* made of metal is also simultaneously discarded, resources are wasted.

SUMMARY OF THE INVENTION

The present invention has been to solved the above-mentioned problems, and it is an object of the present invention to provide a thermal transfer printer which includes a ribbon guide section capable of guiding an ink ribbon provided in a main body case so that the ribbon guide section is not mounted on the ribbon cassette. Therefore, it is possible to reduce resource waste at low running cost.

According to a first aspect of the present invention to solve the above-mentioned problems, a thermal transfer printer includes a ribbon cassette having a first ribbon housing section for housing a supply reel around which an unused ink ribbon is wound and a second ribbon housing section for housing a take-up reel around which a used ink ribbon is wound, a cassette mounting section on which the ribbon cassette can be mounted, a thermal head, a platen roller which can be brought into contact with and separated from the thermal head, and a paper feeding mechanism capable of carrying a recording paper which is fed between the platen roller and the thermal head. The ribbon cassette is provided with a head insertion section in which the thermal head is positioned and a relief groove having a predetermined depth in which the paper feeding mechanism can be positioned between the first ribbon housing section and the second ribbon housing section, and the ink ribbon to be wound around the take-up reel is exposed to the relief groove. A ribbon guide section is arranged in the cassette mounting section so that the ink ribbon exposed to the relief groove of the mounted ribbon cassette can be bent toward the lower portion of the relief groove to be wound around the take-up reel.

Further, according to a second aspect of the invention to solve the above-mentioned problems, in the thermal transfer printer, the ribbon cassette includes a partitioning wall for partitioning the head insertion section and the relief groove, and when the ink ribbon cassette is mounted on the cassette mounting section, the ink ribbon can be drawn out from the supply reel through an end of the partitioning wall and the ribbon guide member to be wound around the take-up reel.

Furthermore, according to a third aspect of the invention to solve the above-mentioned problems, the ribbon guide section is composed of a rotatable guide roller.

The ink ribbon to be wound around the take-up reel is exposed to the relief groove of the ribbon cassette, and the cassette mounting section is provided with the ribbon guide portion which can bend the ink ribbon exposed to the relief groove of the mounted ribbon cassette toward the lower portion of the relief groove in order to be wound around the take-up reel. Therefore, the ribbon guide section may be not mounted on the ribbon cassette and a thermal transfer printer with low running cost can be provided because the cost of ribbon cassette can be reduced. In addition, resources can be prevented from being wasted.

In addition, the ribbon cassette is provided with the partitioning wall for partitioning the head insertion section and the relief groove, and is mounted on the cassette mounting section. Since the ink ribbon is drawn out from the supply reel through an end of the partitioning wall and the ribbon guide member so as to be wound around the take-up reel, it is possible to prevent the paper feeding mechanism positioned in the relief groove from being brought into contact with the ink ribbon.

DESCRIPTION OF THE PREFERRED EMBODIMENT

Hereinafter, preferred embodiment of a thermal transfer printer 1 according to the present invention will be described with reference to the drawings.

Figure 1:
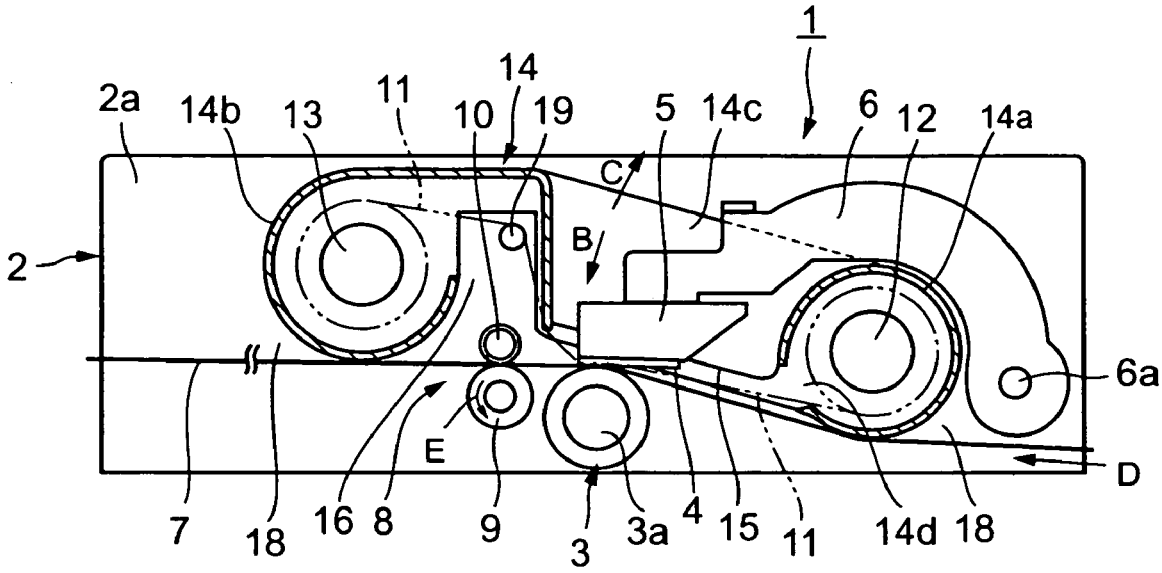
FIG. 1 is a schematic view illustrating a thermal transfer printer according to the present invention.
Figure 2:
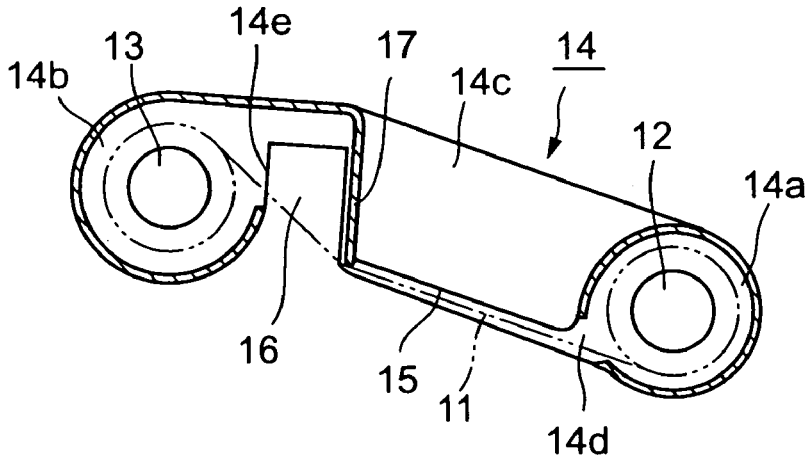
FIG. 2 is a cross-sectional view showing the main parts of a ribbon cassette according to the invention.
Figure 3:
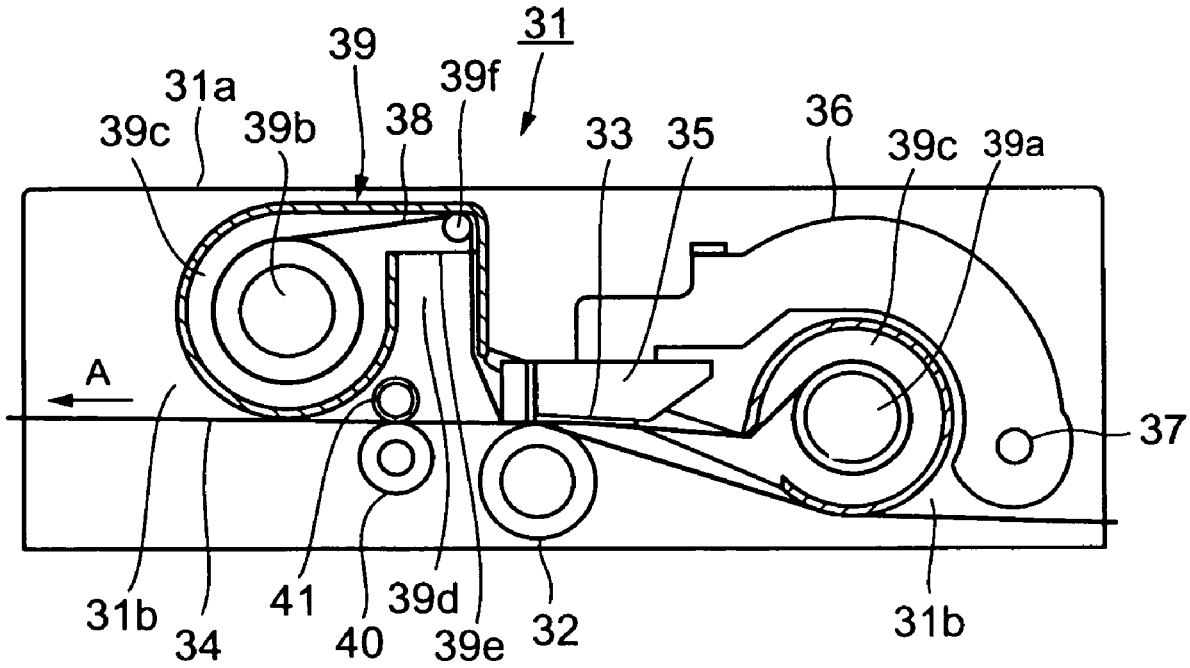
FIG. 3 PRIOR ART
FIG. 3 is a schematic view illustrating the main parts of a printer according to the related art.

FIG. 1 is a schematic view illustrating a thermal transfer printer according to the present invention and FIG. 2 is a cross-sectional view showing the main parts of a ribbon cassette according to the invention.

As shown in FIG. 1, the thermal transfer printer 1 according to the invention is provided with a cylindrical platen roller 3 having a predetermined length in a main body case 2. Both ends of a rotating shaft 3*a* of the platen roller 3 are rotatably supported by side walls 2*a* of the main body case 2.

In addition, a thermal head 4 extending parallel to the longitudinal direction of the platen roller 3 is arranged on the upper side of the platen roller 3 and is mounted on a trapezoidal head mounting table 5. The head mounting table 5 is mounted on the head lever 6 having an arm shape and the head lever 6 can swing about a swing point 6*a* as a fulcrum in the direction of arrows B and C which is the up and down direction in the drawing.

The thermal head 4 can move up and down with respect to the platen roller 3 by swing the head lever 6 in the direction of the arrows B and C. Further, a recording paper 7 is fed between the platen roller 3 and the thermal head 4.

The thermal head 4 has a plurality of heat generating elements (not shown) provided in the portion facing the platen roller 3.

Furthermore, a paper feeding mechanism 8 is arranged in the downstream side of the platen roller 3 in the feeding direction of the recording paper 7 which is indicated by an arrow D, and the paper feeding mechanism 8 is composed of a paper feeding roller 9 which can be driven to rotate and a pressing roller 10 which is pressed against the paper feeding roller 9.

In a state in which the recording paper is interposed to be pressed between the paper feeding roller 9 and the pressing roller 10, the thermal head 4 is moved down so as to perform printing and the recording paper 7 is carried downstream (the left direction in the drawing) by the rotation of the paper feeding roller 9 in the counterclockwise direction, i.e. the direction of an arrow E.

An ink ribbon 11 shown with a two-dot chain line is fed on the upper side of the recording paper 7 fed between the platen roller 3 and the thermal head 4. The ink ribbon 11 is formed to have slightly wider width than that of the recording paper 7. A desired color of ink is coated on the lower surface of the in ribbon 11 in the drawing (the surface facing the recording paper 7), so that the ink can be transferred onto the recording paper 7 by the thermal head 4. The ink ribbon 11 is housed in a cassette 14 with both ends thereof wound around the supply reel 12 and the take-up reel 13, respectively.

As shown in FIG. 2, the ribbon cassette 14 includes a first ribbon housing section 14*a* for housing the supply reel 12 around which unused ink ribbon 11 is wound, and a second ribbon housing section 14*b* for housing the take-up reel 13 around which used ink ribbon 11 is wound.

The first and second ribbon housing sections 14*a* and 14*b* are connected by connection walls 14*c* which are formed to face each other. A draw-out port 14*d* through which the ink ribbon 11 wound around the supply reel 12 can be drawn out is provided in the lower portion of the first ribbon housing section 14*a*.

The ribbon cassette 14 has a head insertion section 15 between the connection walls 14*c* facing each other, in which the thermal head 4 can be positioned and move up and down between the first ribbon housing section 14*a* and the second ribbon housing section 14*b*.

Further, a relief groove 16 having a predetermined depth is provided between the head insertion section 15 and the second ribbon housing section 14*b*, so that the paper feeding mechanism 8 can be positioned therein.

Furthermore, a partitioning wall 17 is formed between the head insertion section 15 and the relief groove 16 in the ribbon cassette 14, and a draw-in port 14*e* through which the ink ribbon 11 drawn out from the draw-out port 14 can be drawn in is provided in the lower side of the relief groove 16.

Moreover, as shown in FIG. 2, the ink ribbon which is drawn out from the draw-out port 14*d* and is drawn through the lower portion of the partitioning wall 17 is exposed to the relief groove 16. The ink ribbon 11 exposed to the relief groove 16 is wound around the take-up reel 13.

In addition, the main body 2 provided with a cassette mounting section 18 in which the ribbon cassette 14 can be mounted. A ribbon guide section 19 composed of a metallic guide roller is rotatably arranged on the side wall 2*a* of the cassette mounting section 18.

When the ribbon cassette 14 is mounted on the cassette mounting section 18, the ribbon guide section 19 is positioned to the lower portion of the relief groove 16, so that the ink ribbon 11 exposed to the relief groove 16 is bent toward the lower portion of the relief groove 16, as shown in FIG. 1.

Therefore, when the ribbon cassette 14 is mounted on the cassette mounting section 18, it is possible to prevent the ink ribbon 11 from bringing into contact with the pressing roller 10 of the paper feeding mechanism 8 and to smoothly wind the ink ribbon 11 around the take-up reel 13.

Further, the supply reel 12 is engaged with a supply-side bobbin (not shown) arranged inside the main body case 2, and the take-up reel 13 is engaged with a take-up side bobbin (not shown).

Hereinafter, a printing operation of the thermal transfer printer 1 of the invention will be described. First, if the head lever 6 is swung in the upward direction of the arrow C at a wide angle so that the ribbon cassette 14 is placed on the cassette mounting section 18 of the main body case 2, the ink ribbon 11 is positioned on the platen roller 3. Simultaneously, the ink ribbon 11 exposed to the relief groove 16 is bent toward the lower portion of the relief groove 16 by the ribbon guide section 19 which is a guide roller made of metal.

After that, the recording paper 7 is fed in the feeding direction of the arrow D so as to be interposed to be pressed between the paper feeding roller 9 and the pressing roller 10. Further, the recording paper 7 is carried in the same direction so that the recording paper 7 is headed. Then, the printing starting position is aligned with the heat generating elements of the thermal head 4. Next, the first color (for example, cyan) of the ink ribbon 11 is headed.

The thermal head 4 is moved down so that the ink ribbon 11 is pressed against the recording paper 7, and a plurality of heat generating elements are selectively heated based on printing information. Next, the paper feeding roller 9 is rotated in the direction of the arrow E so that the recording paper 7 is carried downstream (the direction of an arrow F). Then, the first color ink of the ink ribbon 11 is thermal-transferred onto the recording paper 7.

When printing of the first color is completed, the recording paper 7 is carried again in the direction of the arrow D to be aligned with the printing starting position and the second color (for example, magenta) of the ink ribbon 11 is headed. In addition, the second color of printing is performed in the same way as the printing of the first color. When such operations are repeatedly performed and desired printing is completed, the recording paper 7 is carried in the direction of the arrow F to be discharged outside from the main body case 2.

The used ink ribbon 11 of which ink has been transferred onto the recording paper is wound around the take-up reel 13 via the ribbon guide section 19.

When unused ink ribbon 11 wound around the supply reel 12 runs out, the used ribbon cassette 14 is removed from the cassette mounting section 18 to be replaced with an unused ribbon cassette 14.

As described so far, the ribbon cassette 14 does not include the guide roller 39*f* made of metal unlike the conventional ribbon cassette 31, which results in cost reduction. For this reason, the running cost of the thermal transfer printer 1 according to the invention, in which the low-cost ribbon cassette 14 is used, can be reduced.

In addition, the ribbon cassette 14 does not include a guide roller made of metal unlike the conventional ribbon cassette. Therefore, even though the ribbon cassette 14 is discarded after used, a guide roller is not discarded, so that waste of resource can be prevented.

The invention claimed is:

1. A thermal transfer printer comprising:

a ribbon cassette having a first ribbon housing section for housing a supply reel around which an unused ink ribbon is wound and a second ribbon housing section for housing a take-up reel around which a used ink ribbon is wound;

a cassette mounting section on which the ribbon cassette can be mounted;

a thermal head;

a platen roller which can be brought into contact with and separated from the thermal head; and a paper feeding mechanism capable of carrying a recording paper which is fed between the platen roller and the thermal head;

wherein the ribbon cassette is provided with a head insertion section in which the thermal head is positioned and a relief groove having a predetermined depth in which the paper feeding mechanism can be positioned between the first ribbon housing section and the second ribbon housing section, and includes a partitioning wall that partitions the head insertion section and the relief groove, and the ink ribbon to be wound around the take-up reel is exposed to the relief groove, and wherein a ribbon guide section is arranged in the cassette mounting section so that the ink ribbon exposed to the relief groove of the mounted ribbon cassette can be bent toward a lower portion of the relief groove to be wound around the take-up reel, and wherein the ribbon cassette is mounted on the cassette mounting section, and the ink ribbon is drawn out from the supply reel through an end of the partitioning wall and the ribbon guide member to be wound around the take-up reel.

2. The thermal transfer printer according to claim 1, wherein the ribbon guide section is composed of a rotatable guide roller.

3. The thermal transfer printer according to claim 1, wherein the partitioning wall prevents the ink ribbon from contacting the paper feeding mechanism positioned in the relief groove.

* * * * *